US006733400B2

(12) United States Patent
Sherwood

(10) Patent No.: US 6,733,400 B2
(45) Date of Patent: May 11, 2004

(54) GOLD CLUB IRON HEAD, CORRELATED SET OF INDIVIDUALLY NUMBERED GOLF CLUB IRONS, METHOD OF MATCHING A GOLF CLUB TO A GOLFER, AND METHOD OF MATCHING A SET OF GOLF CLUBS TO A GOLFER

(75) Inventor: Brad L. Sherwood, Spokane, WA (US)

(73) Assignee: U.I.G., Inc., Reno, NV (US)

( * ) Notice: Subject to any disclaimer, the term of this patent is extended or adjusted under 35 U.S.C. 154(b) by 0 days.

(21) Appl. No.: 09/838,944

(22) Filed: Apr. 20, 2001

(65) Prior Publication Data

US 2002/0193173 A1 Dec. 19, 2002

(51) Int. Cl.[7] ..... A63B 53/04
(52) U.S. Cl. ..... 473/290; 473/331
(58) Field of Search ..... 473/330, 324, 473/331, 290, 291

(56) References Cited

U.S. PATENT DOCUMENTS

| | | | |
|---|---|---|---|
| 732,136 | A | 6/1903 | Taylor |
| 732,137 | A | 6/1903 | Taylor |
| 780,776 | A | 1/1905 | Brown |
| D44,457 | S | 8/1913 | Taylor |
| 1,089,881 | A | 3/1914 | Taylor |
| 1,188,479 | A | 6/1916 | Park |
| 1,289,553 | A | 12/1918 | Sanders |
| 1,337,958 | A | 4/1920 | Reach |
| D55,278 | S | 5/1920 | Kraeuter |
| D55,644 | S | 7/1920 | Reach |
| D57,980 | S | 5/1921 | Kraeuter |
| 1,402,537 | A | 1/1922 | Reach |
| D63,284 | S | 11/1923 | Challis |
| 1,511,479 | A | 10/1924 | Kelly et al. |
| 1,532,545 | A | 4/1925 | Pedersen |
| 1,540,550 | A | 6/1925 | East |
| 1,743,957 | A | 1/1930 | Carr |
| D83,700 | S | 3/1931 | Schmermund |
| 1,835,718 | A | 12/1931 | Morton |
| 1,840,451 | A | 1/1932 | Jansky |
| 1,854,548 | A | 4/1932 | Hunt |
| 1,927,083 | A | 9/1933 | Davis |
| 1,965,954 | A | 7/1934 | Davis |
| 2,005,401 | A | 6/1935 | Storz |
| D96,478 | S | 8/1935 | Jansky |
| 2,034,936 | A | 3/1936 | Barnhart |

(List continued on next page.)

*Primary Examiner*—Stephen Blau
(74) *Attorney, Agent, or Firm*—Wells St. John P.S.

(57) ABSTRACT

The invention includes a golf club iron head, correlated sets of individually numbered golf club irons, methods of matching a golf club to a golfer, and methods of matching a set of golf clubs to a golfer. In one implementation, a golf club iron head includes a front striking face, a sole, a toe, and a heel. The front striking face has a series of grooves of a common cross sectional shape from the top to the bottom. Individual grooves have a base and opposing sidewalls which diverge from the base and extend outwardly in the direction of the front striking face. The sidewalls include opposing protrusions extending into the groove proximate the front striking face. In one implementation, the front striking face of a golf club iron head defines a symmetrical groove cross section. The groove base comprises a protrusion extending in the direction of the front striking face. The base protrusion has an apex received inwardly of the front striking face. In one implementation, a correlated set of individually numbered golf club irons have heads progressing from a high numbered head to a low numbered head. For at least two chosen pairs of heads within the set, the grooves in the heads are configured to provide decreasing golf ball spin in going from the lower numbered head to the higher numbered head in the pair if the golf ball were hit by the faces by identical impacts at the same loft angle.

40 Claims, 7 Drawing Sheets

U.S. PATENT DOCUMENTS

D101,108 S 9/1936 Ellingham
2,144,846 A 1/1939 Kruspe
D122,795 S 10/1940 Geerlings
2,307,193 A 1/1943 Bellis
D138,380 S 7/1944 Myers
D140,085 S 1/1945 Myers
D148,193 S 12/1947 Smith
2,447,967 A 8/1948 Stone
2,478,468 A 8/1949 Drake
2,520,950 A 9/1950 Miller
2,542,081 A 2/1951 Hockey
D164,469 S 9/1951 Behrendt et al.
D179,816 S 3/1957 Penna
D179,818 S 3/1957 Penna
D184,054 S 12/1958 Huthsing
D190,034 S 4/1961 Penna
D190,035 S 4/1961 Hansen
D190,430 S 5/1961 Penna
D192,336 S 3/1962 Grosso
D193,098 S 6/1962 Davis
3,079,157 A 2/1963 Turner
3,088,736 A 5/1963 Mospan
D197,524 S 2/1964 Behrendt
3,260,525 A 7/1966 Ortel
D210,033 S 1/1968 Jonhston
D212,293 S 9/1968 Brown
D215,101 S 9/1969 Sabat
D222,679 S 11/1971 Gryseels
D228,564 S 10/1973 Braly
3,869,126 A 3/1975 Thompson
3,881,733 A 5/1975 Csernits
D240,054 S 5/1976 Meissler
D240,949 S 8/1976 Jones
D241,359 S 9/1976 Taylor
D247,633 S 3/1978 Shaw
D250,282 S 11/1978 Brigham, Jr. et al.
4,203,598 A 5/1980 Stuff et al.
D257,736 S 12/1980 Lyon et al.
4,260,157 A 4/1981 Jones et al.
D264,368 S 5/1982 Van Dyke et al.
4,461,482 A 7/1984 Bojicic
4,529,203 A 7/1985 Ridaudo
4,679,792 A 7/1987 Straza et al.
4,725,062 A 2/1988 Kinney, III
D294,850 S 3/1988 Simmons
4,754,971 A * 7/1988 Kobayashi
4,768,787 A 9/1988 Shira
D298,447 S 11/1988 Cook
D301,907 S 6/1989 Muta
D302,452 S 7/1989 Walsh
D302,716 S 8/1989 Giambazi
D303,415 S 9/1989 Chorne
4,964,641 A 10/1990 Miesch et al.
5,029,864 A 7/1991 Keener
5,029,865 A 7/1991 Kim
5,037,102 A 8/1991 Fukayama et al.
D320,427 S 10/1991 Antonious
5,090,702 A 2/1992 Viste
5,094,101 A 3/1992 Chastonay
D327,931 S 7/1992 Stuff
D327,932 S 7/1992 Stuff
5,141,231 A 8/1992 Cox
5,193,806 A 3/1993 Burkly
5,198,062 A 3/1993 Chen
D336,758 S 6/1993 Jossey
D343,435 S 1/1994 Poincenot et al.
D344,999 S 3/1994 Brown et al.
D345,775 S 4/1994 Poincenot et al.
D346,840 S 5/1994 Fenton
5,328,171 A 7/1994 Saito
5,333,862 A 8/1994 Teramoto et al.
5,348,301 A 9/1994 Ma
5,351,952 A 10/1994 Hackman
5,354,059 A 10/1994 Stuff
5,358,249 A 10/1994 Mendralla
D354,785 S 1/1995 Luks
5,377,986 A 1/1995 Viollaz et al.
5,388,826 A 2/1995 Sherwood
D356,133 S 3/1995 Desmarais
5,397,127 A 3/1995 Kawada et al.
5,423,546 A 6/1995 Manning et al.
D360,668 S 7/1995 Hattori
5,437,088 A 8/1995 Igarashi
5,441,256 A 8/1995 Hackman
5,451,056 A 9/1995 Manning
5,497,993 A 3/1996 Shan
5,505,450 A 4/1996 Stuff
5,509,660 A 4/1996 Elmer
5,531,439 A 7/1996 Azzarella
5,564,991 A 10/1996 Hirose
D376,632 S 12/1996 Simmons
5,591,091 A 1/1997 Hackman
5,591,092 A 1/1997 Gilbert
5,595,547 A 1/1997 Lekavich
5,607,363 A 3/1997 Chou
5,618,239 A 4/1997 Rife
5,620,381 A 4/1997 Spalding
5,620,382 A 4/1997 Cho et al.
5,626,528 A 5/1997 Toulon
5,637,044 A 6/1997 Swash
5,643,099 A 7/1997 Solheim
5,665,013 A 9/1997 Kobayashi
5,688,186 A 11/1997 Michaels et al.
5,688,190 A 11/1997 Rowland et al.
5,690,561 A 11/1997 Rowland et al.
D388,144 S 12/1997 Lukasiewicz
5,709,616 A * 1/1998 Rife ..... 473/330
5,709,617 A 1/1998 Nishimura et al.
D393,673 S 4/1998 Cope et al.
5,755,626 A 5/1998 Shira
5,766,087 A * 6/1998 Kawamatsu
5,879,241 A 3/1999 Cook et al.

* cited by examiner

GOLD CLUB IRON HEAD, CORRELATED SET OF INDIVIDUALLY NUMBERED GOLF CLUB IRONS, METHOD OF MATCHING A GOLF CLUB TO A GOLFER, AND METHOD OF MATCHING A SET OF GOLF CLUBS TO A GOLFER

TECHNICAL FIELD

This invention relates to golf club iron heads, to correlated sets of individually numbered golf club irons, to methods of matching a golf club to a golfer, and to methods of matching a set of golf clubs to a golfer.

BACKGROUND OF THE INVENTION

A complete set of golf club irons typically includes a set of twelve irons numbered from 2 (long) through 9 (short), a pitching wedge (PW), a gap wedge (GW) and a sand wedge (SW). A 1-iron is also sometimes included in the set, although the average golf club set does not include a 1-iron due to difficulty in using the club. Each iron typically comprises a head including a hosel and a shaft which is attached to the head by fitting the shaft into a bore of the hosel. The hosel is integrally formed as part of the head. The head also includes a heel, a bottom sole, a toe, a planar striking face, and a back side.

The typical twelve irons of a golf club set have varying degrees of loft angle. The loft angle of an iron is the angle between a vertical plane, which includes the shaft, and the plane of the striking face of the iron. The loft angle effects how much loft is imparted to the ball when it is struck by the tilted, striking face.

Longer-hitting irons (i.e., #2, #3, #4) have progressively longer golf club shafts than the shorter-hitting irons (i.e., #5, #6, #7, #8, #9, PW, SW). Typically, the length of the golf club shaft progressively increases in length from PW through the 2-iron. Further, it is a typical design criteria that each golf club within a set have the same substantially identical swing weight. As the volume of shaft is different for each club due to varying length, the mass of the club head is varied inversely to the length of the shaft such that a substantially constant swing weight is achieved for each club within a complete set. Accordingly, typically the PW head is heaviest and the 2-iron head is lightest within a given set 2-iron through PW.

The amount of spin imparted to a golf ball is affected by a combination of the design of the club head and the impact the golfer makes with the ball. Professional golfers, because of their ability, typically can modify their swing and impact selectively, particularly with the higher numbered short irons, to affect the degree of backspin a ball will have when hitting the green. Degree of backspin on the ball when it hits in part determines where the ball will stop. At some point, the back spin can become so great that the ball draws back from where it hits the green.

Relative to head design, probably the most significant feature impacting the degree of backspin that can be put on a ball relates to the groove design in the face of a golf club iron head. The U.S.G.A. has rules which impact the configuration of groove design for golf clubs. The existing U.S.G.A. rules read:

> A series of straight grooves with diverging sides and a symmetrical cross-section may be used (see FIG. IX). The width and cross-section must be consistent across the face of the club and along the length of the grooves. Any rounding of groove edges shall be in the form of a radius which does not exceed 0.020 inches (0.5 mm). The width of the grooves shall not exceed 0.035 inches (0.9 mm), using the 30 degree method of measurement on file with the United States Golf Association. The distance between edges of adjacent grooves must not be less than three times the width of a groove, and not less than 0.075 inches (1.9 mm). The depth of a groove must not exceed 0.020 inches (0.5 mm).

It would be most desirable to develop improved groove designs which fall within the scope of the existing or future U.S.G.A. rules.

SUMMARY

The invention includes a golf club iron head, correlated sets of individually numbered golf club irons, methods of matching a golf club to a golfer, and methods of matching a set of golf clubs to a golfer. In one implementation, a golf club iron head includes a front striking face, a sole, a toe, and a heel. The front striking face has a planar area having a top and a bottom. The front striking face has a series of grooves of a common cross sectional shape from the top to the bottom. Individual grooves have a base and opposing sidewalls which diverge from the base and extend outwardly in the direction of the front striking face. The sidewalls include opposing protrusions extending into the groove proximate the front striking face. In one preferred embodiment, the respective opposing sidewall protrusions comprise a curved outer surface which starts from the front striking face and curves continuously to its sidewall.

In one implementation, the front striking face of a golf club iron head defines a symmetrical groove cross section. The groove base comprises a base protrusion extending in the direction of the front striking face. The base protrusion has an apex received inwardly of the front striking face.

In one implementation, a correlated set of individually numbered golf club irons have heads progressing from a high numbered head to a low numbered head. Individual heads have a front striking face, a sole, a toe, and a heel. The front striking faces of heads within the set individually have a planar area defining a progressively decreasing loft angle in going from the high numbered head to the low numbered head. The planar area has a top and a bottom. Individual front striking faces have a series of grooves of a common cross sectional shape from the top to the bottom. For at least two chosen pairs of heads within the set, the grooves are configured to provide decreasing golf ball spin in going from the lower numbered head to the higher numbered head in the pair if the golf ball were hit by the faces by identical impacts at the same loft angle.

Either or both of the above first two stated implementations, and/or others, might be utilized in the third stated implementation. Further, the invention contemplates methods of matching a golf club to a golfer and methods of matching a set of golf clubs to a golfer independent of the first three stated implementations.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
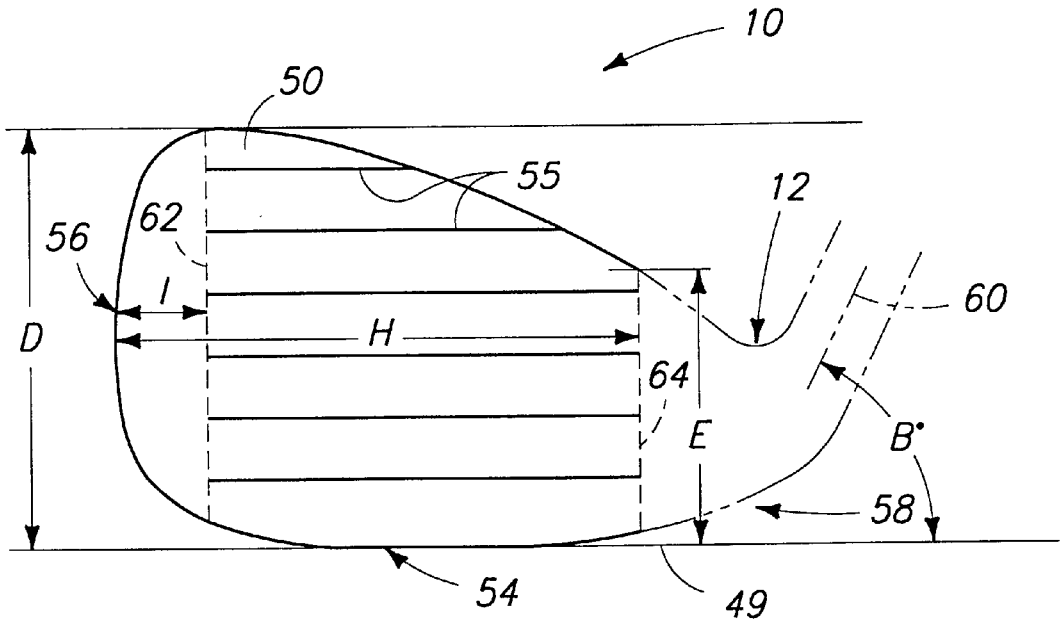
FIG. 1 is a front striking face area view of an iron golf club head in accordance with an aspect of the invention.

This disclosure of the invention is submitted in furtherance of the constitutional purposes of the U.S. Patent Laws "to promote the progress of science and useful arts" (Article 1, Section 8).

A first embodiment golf club iron head in accordance with but one aspect of the invention is initially described with reference to FIGS. 1–5. Such shows various aspects with respect to a PW, although other numbered clubs are of course contemplated. The FIGS. 1–5 club head is designated generally with numeral 10. Such comprises a front striking face 50, a rear face 52, a sole 54, a toe 56, a heel 58 and a hosel 60. Front striking face 50 defines a total, substantially planar, hitting area starting from where the hosel integrally forms into a planar hitting area. Horizontal scoring lines or grooves 55 are formed in striking face 50, and extend between a toe-end vertical terminus location 62 and a heel-end vertical terminus location 64. A preferred set of golf clubs would be manufactured in accordance with Table II of my U.S. Pat. No. 5,388,826, which is hereby fully incorporated by reference, although such is in way required.

In FIG. 1, angle "B" is the lie angle. Dimension "E" is the height from a tangent line 49 of the sole to the highest point of the heel-side scoring line terminus. The heel-side scoring line terminus is generally constantly spaced throughout the set from the point where the planar portion of the hitting face starts becoming non-planar as it forms into the hosel, being approximately 6 mm outwardly therefrom. "H" is the distance from the heel-side scoring line terminus location to the furthest toe portion of the head. "I" is the distance from the toe-side scoring line terminus and furthest toe portion of the head. Dimension "D" is the distance between the sole tangent and the highest-most elevation of the club head.

Figure 2:
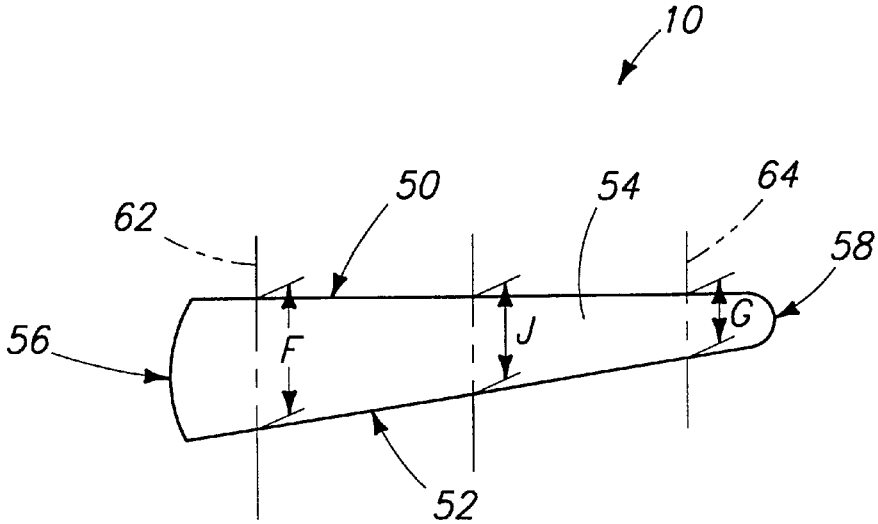
FIG. 2 is a sole view of the iron golf club head of FIG. 1.

FIG. 2 is an upward sole view of a given club. Dimension "G" is the thickness of the sole at the heel-side scoring line terminus. Dimension "F" is the thickness of the sole at the toe-side scoring line terminus. Dimension "J" is the thickness of the sole at the midpoint between the respective heel-side scoring line terminus and toe-side scoring line terminus.

Figure 3:
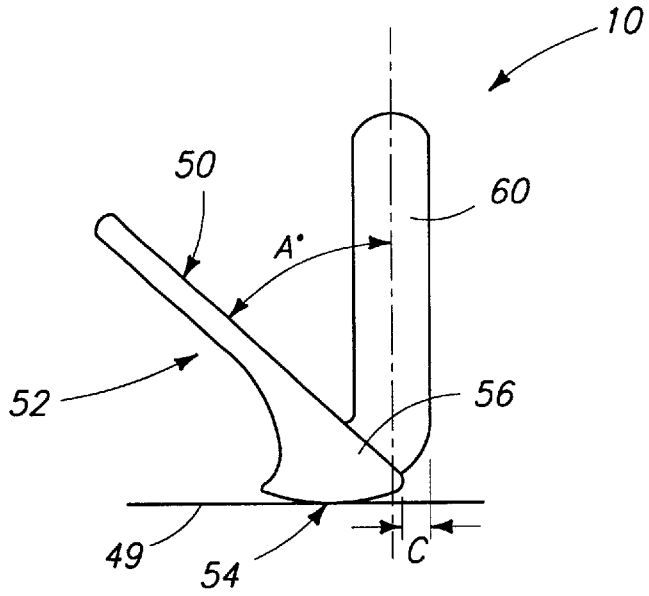
FIG. 3 is a toe-end view of the iron golf club head of FIG. 1.

Referring to FIG. 3, "A" degrees is the loft angle and dimension "C" is the offset angle between the base of the leading edge of the hitting face and the forward-most portion of the hosel. In a preferred set, offset is constant although varying or progressively changing offsets could, of course, be provided.

Figure 4:
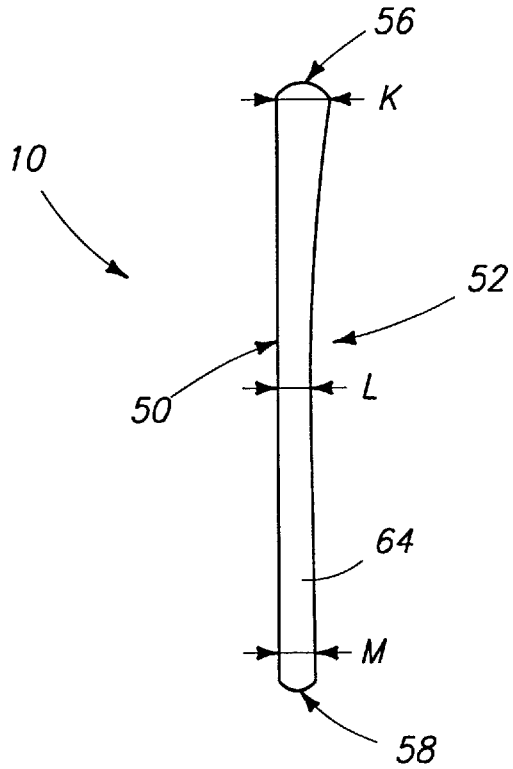
FIG. 4 is a top view of the iron golf club head of FIG. 1.

Referring to FIG. 4, "L" is the thickness of the top-most portion of the club at the striking face center between the respective heel-side scoring line terminus and toe-side scoring line terminus. Dimension "K" is the thickness adjacent the toe-most portion of the head. Dimension "M" is the thickness of the top of the head over the heel-most side scoring line terminus.

The FIG. 1 view is taken with striking face 50 being vertically oriented, or alternately considered with face 50 being parallel with respect to the plane of the page. Accordingly, hosel 60 would angle significantly out of the page in the direction of the reader in accordance with the loft angle of the head.

Figure 5:
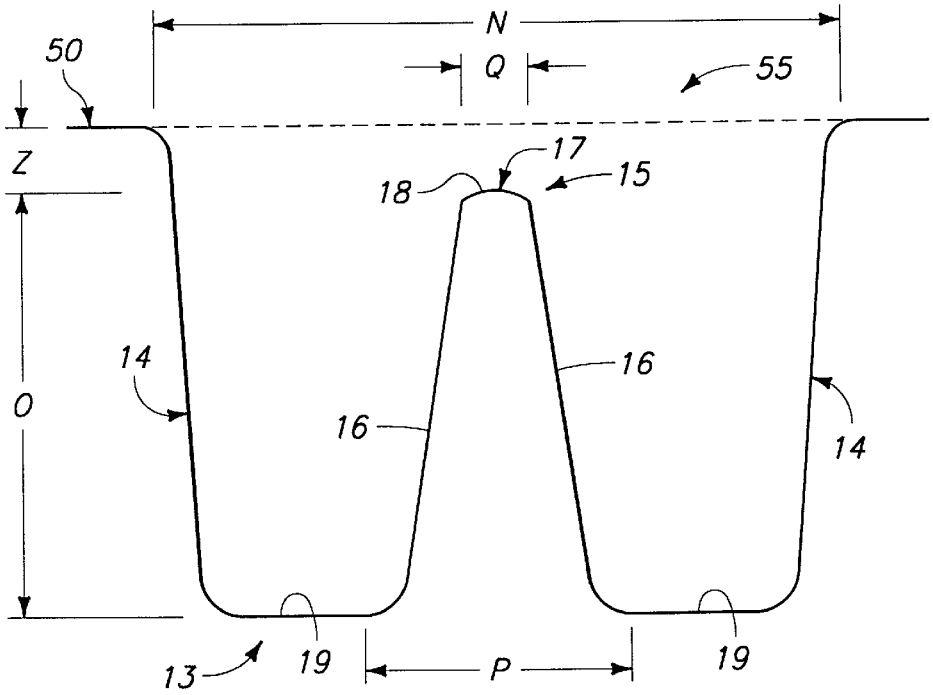
FIG. 5 is a diagrammatic sectional view of a groove design in accordance with an aspect of the invention.

Grooves 55 in the preferred embodiment are provided as a series associated with front striking face 50, and are of a common cross-sectional shape from the top to the bottom of the planar hitting area and along their length. Referring to FIG. 5, individual grooves have a base 13 and opposing sidewalls 14 which diverge from base 13 and extend outwardly in the direction of front striking face 50, and define a symmetrical groove cross section. Various groove designs for base 13 and sidewalls 14 could be utilized, with varying degrees of radius of curvature where sidewall 14 joins with base 13 and striking face 50, with most preferably the groove design being manufactured in accordance with U.S.G.A. rules. The illustrated and preferred embodiment shows a general square groove construction, although V-groove or other designs are of course contemplated, with the invention only being limited by the accompanying claims appropriately interpreted in accordance with the Doctrine of Equivalents.

As part of the base 13, a base protrusion 15 extends in the direction of front striking face 50 and preferably runs along the length of the groove. In the preferred embodiment, base 13 comprises only a single projection within a groove 55, and has opposing base walls 16 which converge from base 13 outwardly in the direction of hitting face 50, terminating at an apex 17. By way of example only, a preferred angle range from face 50 for respective base walls 16 is from 45° to 89°. Apex 17 in the preferred embodiment is defined on a base protrusion surface 18 which is curved. Most preferably, base protrusion surface 18 has a substantially constant radius of curvature, with from about 0.001 mm to about 0.005 mm believed to be preferred.

Base protrusion apex 17 is received inwardly of front striking face 50 by a distance "Z". Further, apex 17 is received outwardly from base 13 a distance "O". Most preferably, distance "Z" is at least 0.001 inch inwardly of front striking face 50 and no greater than about 0.018 inch.

Base 13 in the depicted and preferred embodiment preferably includes a flat portion, with two flat portions 19 being shown. Further preferably, apex 17 is preferably centrally located between sidewalls 14, as shown. Further, base protrusion opposing sidewalls 16 have at least two and thereby variable widths between groove sidewalls 14. In the depicted and preferred embodiment, base walls 16 define a continuous variable width for protrusion 15 between groove sidewalls 14 from a maximum dimension "P" to a minimum dimension "Q". Preferably, the minimum width "Q" is no less than about 0.001 inch, and the maximum width "P" is no greater than about 0.025 inch. It is expected, although not required, that the above groove design will decrease backspin for increasing values of "Z", at least to some undetermined value.

In accordance with but one aspect of the invention, aspects of the above described preferred first embodiment are utilized in a correlated set of individually numbered golf club irons having heads progressing from a high numbered head to a low numbered head. Base protrusions having apexes are utilized within the grooves of the heads, and the base protrusions and other design features of the groove might be the same or different for different clubs within the set. Regardless in accordance with this aspect of the invention, for at least two chosen pairs of heads within the set, the apex is displaced inwardly of the front striking face a greater amount in the higher numbered head compared to the lower numbered head in the pair. The words "set", "pair" and "pairs" are utilized in this document essentially in the same manner as was used in my U.S. Pat. No. 5,388,826. Accordingly, a set constitutes a minimum of three clubs and any two chosen pairs in such instance could include a common head from the set.

Figure 6:
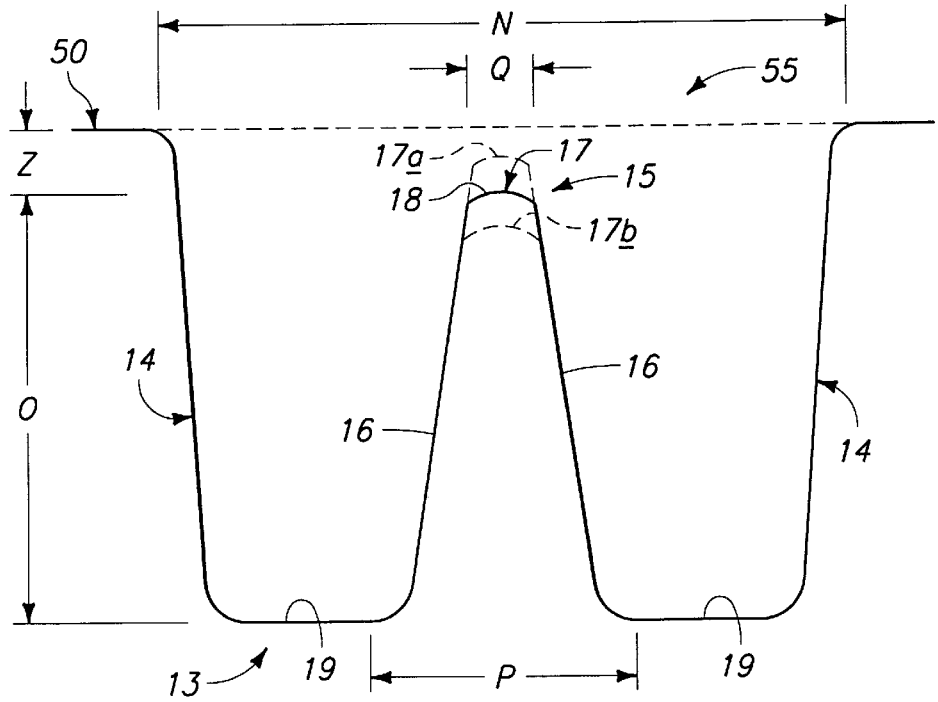
FIG. 6 is a diagrammatic sectional view of a groove design in accordance with an aspect of the invention.

An exemplary correlated set in accordance with this aspect of the invention is described with reference to FIG. 6, wherein different apexes 17, 17*a* and 17*b* are diagrammatically shown for different preferred heads within the iron set. By way of example only, advantageous aspects of the invention (for example, and by way of example only, wicking away of dirt and/or grass upon impact) might be attainable by providing a 10-iron set of heads having 10 different displacements "Z" of the respective apexes 17 from outer hitting faces 50. Alternately by way of example only, advantageous aspects of the invention might be attainable by providing a 10-iron set of heads having only three or other number different size/dimensions "Z" for a full set.

Specifically and again by way of example only, the 2-iron head and the 3-iron head might each be manufactured to have the exact same dimension "Z" and otherwise the same groove configuration; the #4, #5 and #6 be manufactured to each have another common, greater dimension "Z"; and the #7, #8, #9 and pitching wedge be manufactured to each have yet another, common further larger dimension "Z". Other relationships might, of course, be used, with the invention only being limited by the concluding claims.

Preferably in accordance with a preferred correlated set, the groove design is such that the grooves are configured to provide decreasing golf ball spin in going from the lower numbered head to the higher numbered head in the pair if the same golf ball were hit by the faces by identical impacts at the same loft angle. In the first preferred FIGS. 5 and 6 embodiments, and where the correlated sets of clubs are otherwise manufactured to have substantially the same groove configuration but for dimension "Z", the larger the "Z" dimension, the lower it is believed will be the degree of spin, assuming otherwise identical impacts of the golf ball at the same loft angle. Accordingly, for otherwise identical impacts of a golf ball at the same angle, a groove design with apex 17*a* is expected to produce the most backspin, with projection apexes 17 and 17*b* producing progressively decreasing backspin on the golf ball.

By way of example only, and not of limitation, believed preferred ranges for "Z" for clubs 2—PW are provided in Table I below.

TABLE I

| | Range for "Z" in inches | |
|---|---|---|
| | High | Low |
| #2 | 0.0010 | 0.0050 |
| #3 | 0.0015 | 0.0055 |
| #4 | 0.0020 | 0.0060 |
| #5 | 0.0025 | 0.0065 |
| #6 | 0.0030 | 0.0070 |
| #7 | 0.0035 | 0.0075 |

TABLE I-continued

| | Range for "Z" in inches | |
|---|---|---|
| | High | Low |
| #8 | 0.0040 | 0.0080 |
| #9 | 0.0045 | 0.0085 |
| PW | 0.0050 | 0.0090 |

An aspect of the invention contemplates variability of dimension "Z" in a correlated set of golf clubs which, for at least two chosen pairs of heads within the set, the apex is displaced inwardly of the front striking face a greater amount in the higher numbered head compared to the lower numbered head in the pair independent of whether decreasing golf ball spin is produced in going from the lower numbered head to the higher numbered head in the pair if the golf ball were hit by the faces by identical impacts at the same loft angle. Further, an aspect of the invention contemplates a correlated set of individually numbered golf club irons where, for at least two chosen pairs of heads within the set, the grooves are configured to provide decreasing golf ball spin in going from the lower numbered head to the higher numbered head in the pair if the golf ball were hit by the faces by identical impacts at the same loft angle independent of whether some or none of the groove design features depicted in FIGS. 5 and 6 are utilized. For example, and by way of example only, the immediately preceding sentence relationship might be achieved by constant dimension "Z" in the set, and variability in one or more other dimensions in FIG. 5, or even in fundamental groove shape changes between clubs. Further by way of example only, conventional square grooves, v-grooves or other existing or yet-to-be developed grooves of constant shape throughout a correlated set, yet with variable size/widths, could be employed. Various combinations could of course be employed.

Further by way of example only, multiple alternate and preferred embodiments which can be utilized to achieve this relationship are described with reference to FIGS. 7–12. Referring first to the FIG. 7 embodiment, an individual groove configuration 75 is depicted. Groove 75 comprises a base 22 and opposing sidewalls 24 which diverge from base 22 and extend outwardly in the direction of a front striking face 26. Sidewalls 24 comprise opposing protrusions 28 which extend into groove 75 proximate front striking face 26. Opposing sidewall protrusions 28 are preferably of the same shape and size, as shown. Sidewall protrusions 28 have an outer surface 29, which in the preferred embodiment is largely semicircular and preferably of substantially constant radius, preferably from at least just laterally inwardly of where extended line 24 intersects with front striking face 26 in accordance with the existing U.S.G.A. 30° Rule. The respective opposing sidewall protrusions preferably comprise a curved outer surface which starts from the front striking face, and most preferably curves continuously to its sidewall.

Sidewall protrusions 28 project inwardly from sidewalls 24 a dimension "T" to an apex 30 which is defined on a sidewall protrusion surface which is curved. In the depicted drawings, "T" is the distance from the apex 30 along a straight horizontal line to where the sidewall would have been if the projection was not there. Further preferably and as shown, apexes 30 are displaced inwardly from front striking face 26 in the direction of base 22. Further preferably, outer surface 29 is semicircular of constant radius "R" from an origin 31 received outwardly of sidewalls 24.

Opposing sidewall projections 28 can be considered as having respective top-most portions 32 and bottom-most portions 34. Top-most portions 32 start projecting into groove 75 from front striking face 26. Accordingly in the preferred embodiment, the respective sidewall protrusions have an outer surface 29 characterized by a substantially constant radius of curvature which starts from front striking face 26. Further, bottom-most portions 34 start projecting into groove 75 from sidewall locations 36. Preferably and as shown, opposing sidewalls 24 extend straight linear from proximate base 22 to bottom-most portions 34 of opposing sidewall protrusions 28 at locations 36. Groove 75 has some maximum groove width "S" from where 30° lines "V" become tangent with surface 29, again all preferably in accordance with the present U.S.G.A. 30° and other rules regarding groove design.

Figure 7:
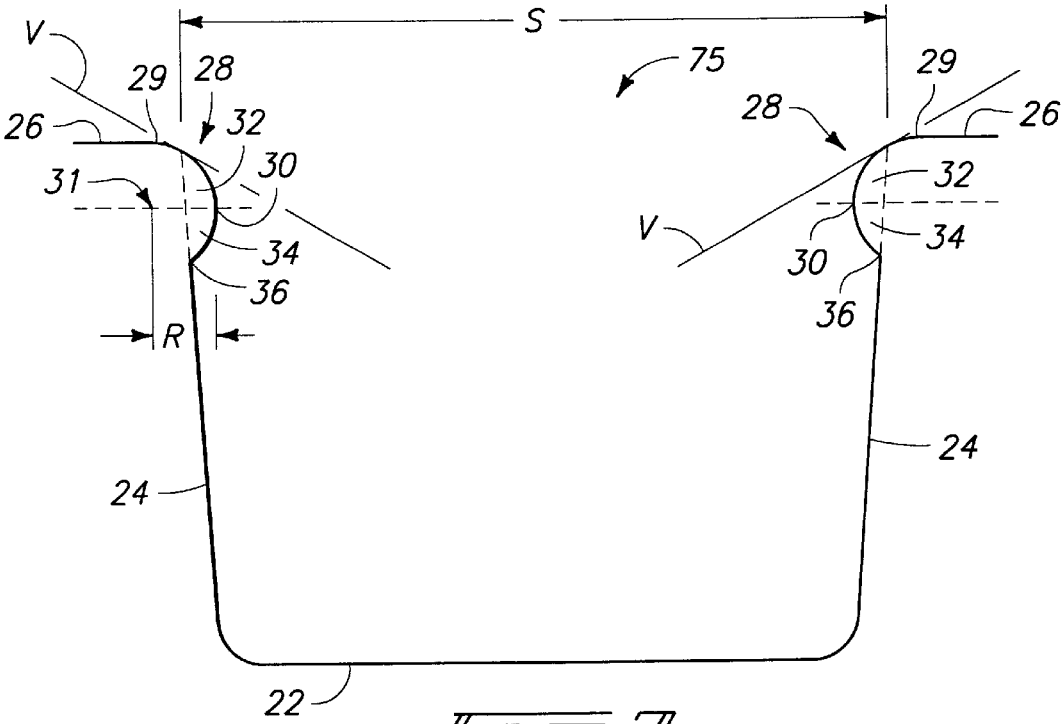
FIG. 7 is a diagrammatic sectional view of a groove design in accordance with an aspect of the invention.
Figure 8:
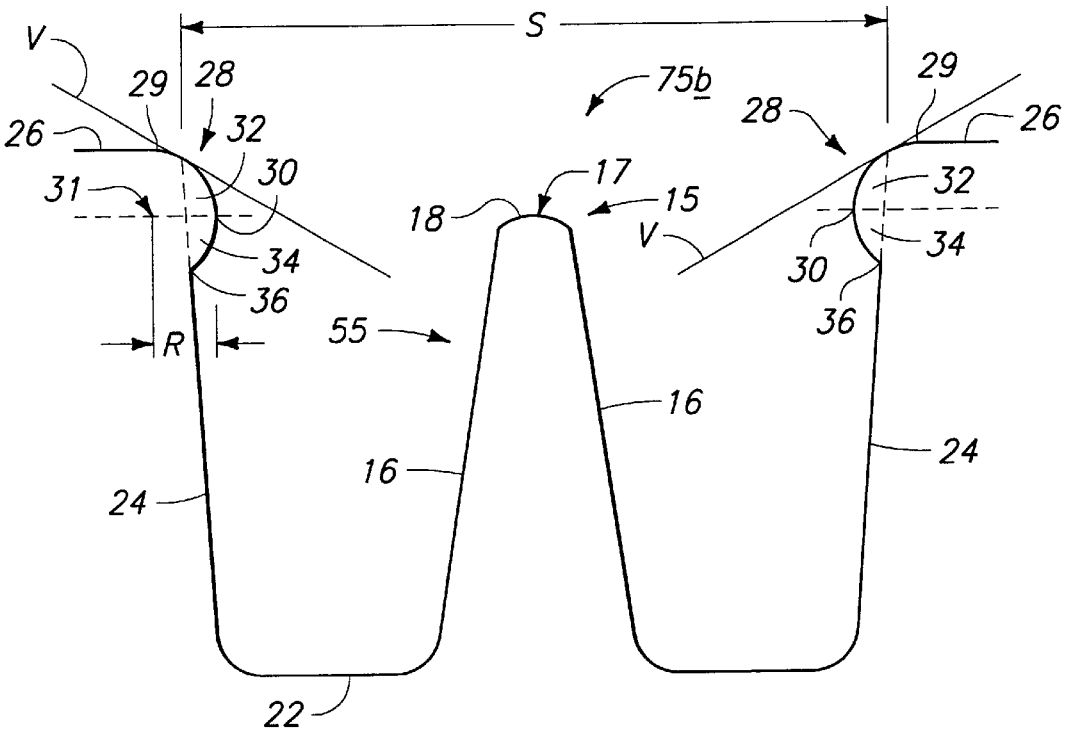
FIG. 8 is a diagrammatic sectional view of a groove design in accordance with an aspect of the invention.

FIG. 8 depicts but one additional alternate embodiment to that depicted by FIG. 7. Like numerals from the FIG. 7 embodiment are utilized where appropriate, with differences being indicated with the suffix "b". The FIG. 8 groove embodiment 75*b* is the same as that of FIG. 7, and includes a further addition of the FIG. 5 embodiment base projection 55.

The invention contemplates additional aspects in a correlated set of individually numbered golf club irons having heads progressing from a high numbered head to a low numbered head. Groove sidewalls of respective heads comprise opposing protrusions which extend into the groove proximate the front striking face of the head. In one embodiment, the sidewall protrusions extend laterally further into the grooves in the higher numbered head compared to the lower numbered head in the pair. In another embodiment, the sidewall protrusions extend laterally further into the grooves in the lower numbered head compared to the higher numbered head in the pair. Again in either, the groove configuration might otherwise be the same or different for different clubs within the set.

Figure 9:
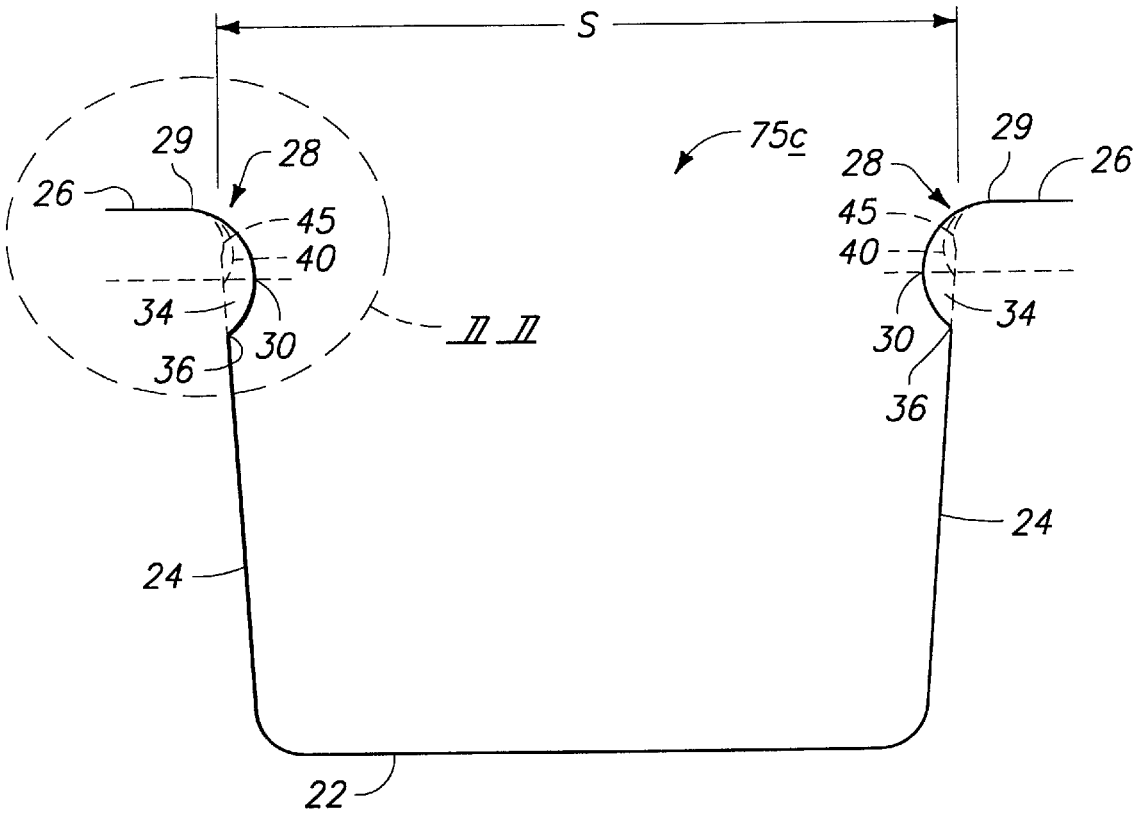
FIG. 9 is a diagrammatic sectional view of a groove design in accordance with an aspect of the invention.
Figure 10:
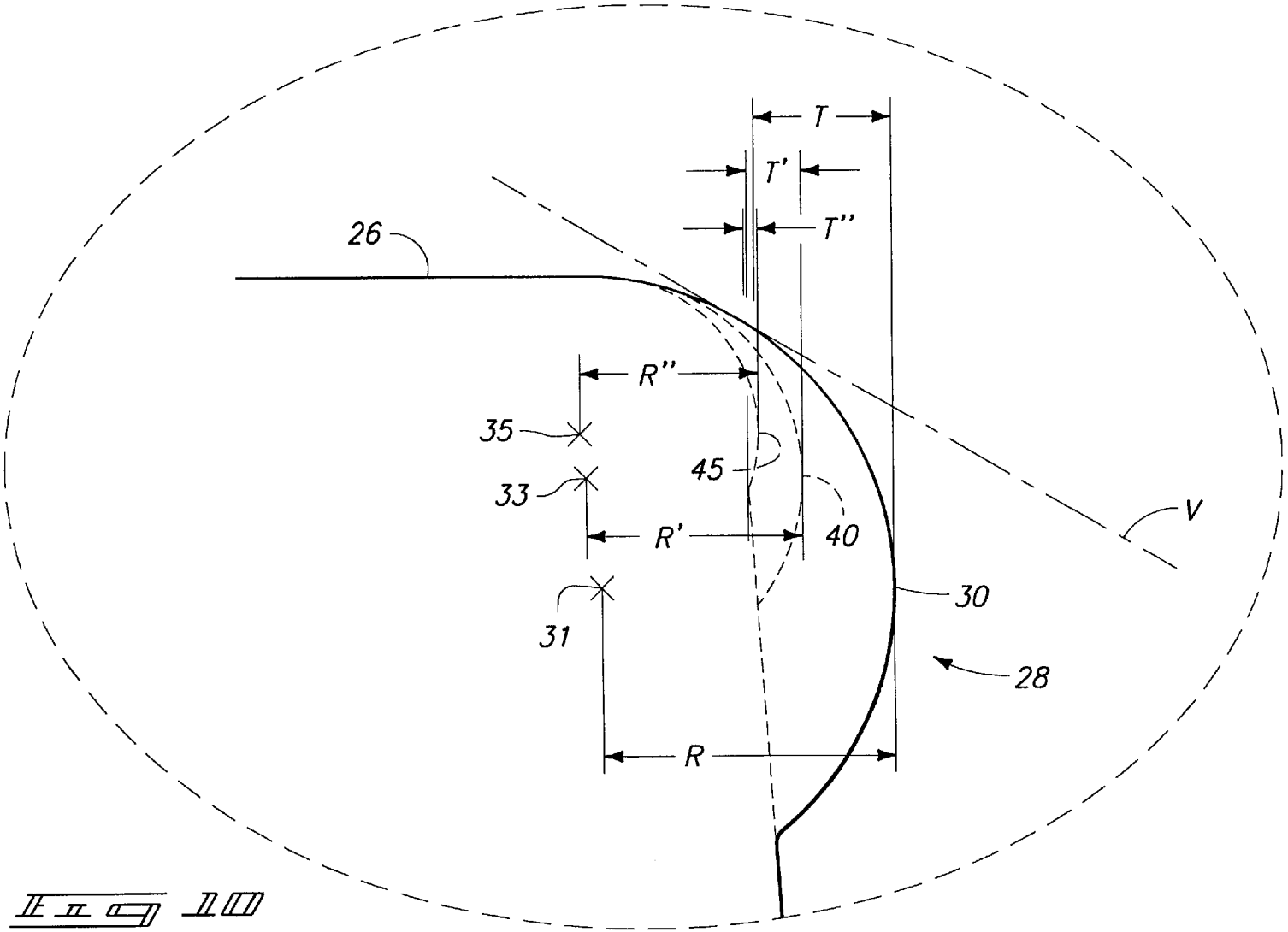
FIG. 10 is an enlargement of a portion of FIG. 9.

FIGS. 9 and 10 depict but one exemplary embodiment. Like numerals from the FIG. 7 embodiment are utilized where appropriate, with differences being indicated with the suffix "c". Here, different sidewall protrusions 28 are depicted as having differing apexes 30, 40 and 45 for different clubs, with corresponding different dimensions R, R', and R" from origins 31, 33 and 35, respectively, and different sidewall displacements T, T' and T". FIGS. 9 and 10 depict sidewall protrusion surfaces for each projection for each head within the set which are formed about a respective constant radius of curvature which is the same for each sidewall protrusion surface for the head. Yet, FIGS. 10 and 11 also depict different radii of curvature for different pairs of the set, with apexes 30, 40 and 45 depicting different radii for different clubs.

Most preferably, and with all other aspects of the groove design preferably remaining constant but for the sidewall projection configuration, and to achieve decreasing golf ball spin in going from the lower numbered head to the higher numbered head in the pair if a golf ball were hit by the faces by identical impacts at the same loft angle, the sidewall protrusions extend laterally further into the groove in the higher numbered head compared to the lower numbered head in the pair. Accordingly, for otherwise identical impacts of a golf ball at the same loft angle, a groove design with apex 45 is expected to produce the most backspin, with projection apexes 40 and 30 producing progressively decreasing backspin on the golf ball.

Figure 11:
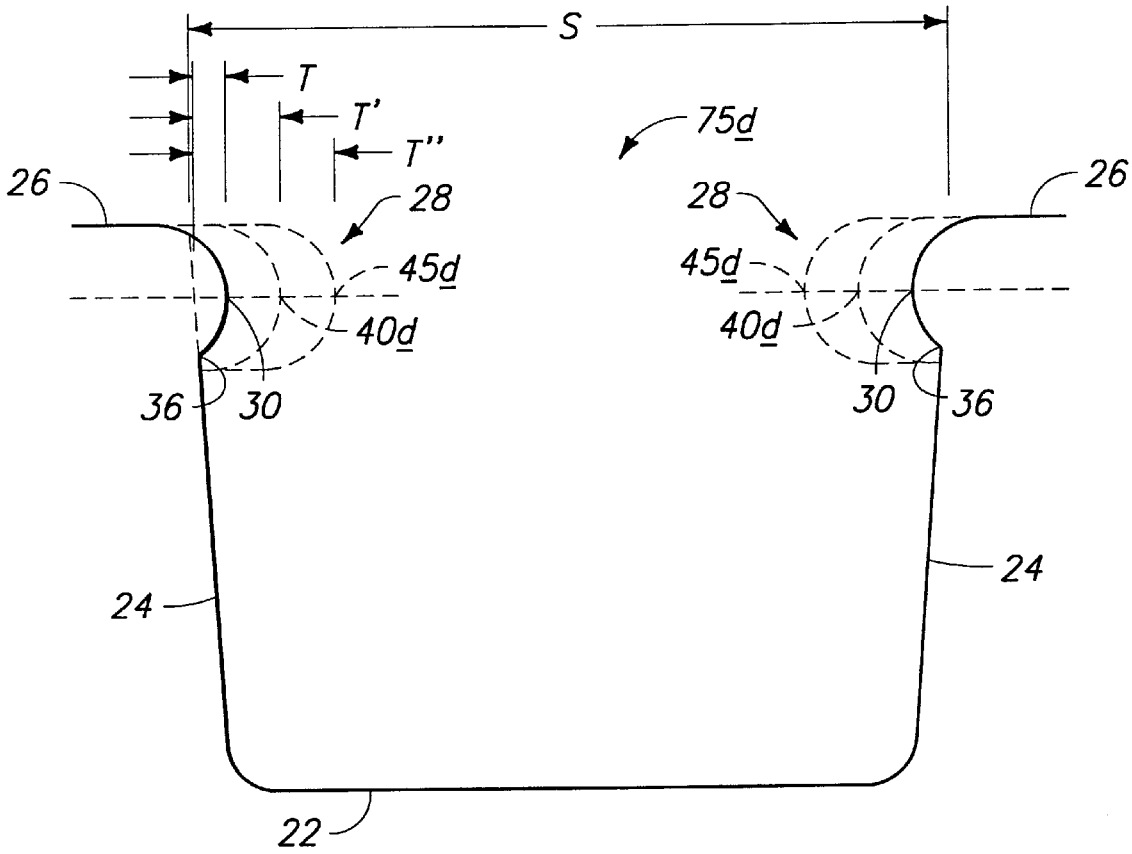
FIG. 11 is a diagrammatic sectional view of a groove design in accordance with an aspect of the invention.

FIG. 11 illustrates but one example alternate embodiment groove design for a correlated set of individually numbered golf club irons having heads progressing from a high numbered head to a low numbered head. Like numerals from the FIG. 9 embodiment are utilized where appropriate, with differences being indicated with the suffix "d". Here, projections 28 are shown for a correlated set of clubs to have different apexes 40*d* and 45*d* which are formed over curved outer surfaces having substantially constant radius of curvature which is the same for each sidewall protrusion surface for the head and for the set, and for accordingly pairs of the set. Most preferably, and with all other aspects of the groove design preferably remaining constant but for the sidewall projection configurations, and to achieve decreasing golf ball spin in going from the lower numbered head to the higher numbered head in the pair if a golf ball were hit by the faces by identical impacts at the same loft angle, the sidewall protrusions extend laterally further into the groove in the higher numbered head compared to the lower numbered head in the pair, at least up to some undetermined value. Accordingly, for otherwise identical impacts of a golf ball at the same loft angle, a groove design with apex 30 is expected to produce the most backspin, with projection apexes 40*d* and 45*d* producing progressively decreasing backspin on the golf ball.

With respect to the FIGS. 9 and 10 embodiment, an by way of example only, exemplary preferred radii of curvatures (thereby dimension "R") for each club 2 through PW are shown in Table II below. Radius of curvature is preferably constant.

TABLE II

| | Radius of Curvature (Dimension "R", in inches) |
|---|---|
| #2 | 0.0010 |
| #3 | 0.0014 |
| #4 | 0.0018 |
| #5 | 0.0022 |
| #6 | 0.0026 |
| #7 | 0.0030 |
| #8 | 0.0034 |
| #9 | 0.0038 |
| PW | 0.0042 |

With respect to the FIGS. 9 and 10 embodiment, exemplary preferred dimensions "T" for each club 2 through PW are shown in Table III below.

TABLE III

| | Dimension "T", in inches |
|---|---|
| #2 | 0.0001 |
| #3 | 0.00014 |
| #4 | 0.00018 |
| #5 | 0.0004 |
| #6 | 0.00065 |
| #7 | 0.0009 |
| #8 | 0.0014 |
| #9 | 0.0017 |
| PW | 0.0020 |

With respect to the FIG. 11 embodiment, and again by way of example only, Table IV depicts exemplary projection ranges "T" for clubs 2 through PW.

TABLE IV

| | Exemplary Projection Ranges, in inches |
|---|---|
| #2 | 0.0038 |
| #3 | 0.0034 |
| #4 | 0.0028 |
| #5 | 0.0024 |
| #6 | 0.0020 |
| #7 | 0.0016 |
| #8 | 0.0012 |
| #9 | 0.0008 |
| PW | 0.0004 |

In one implementation, the invention also contemplates in another aspect a method of matching a golf club to a golfer. Such method comprises manufacturing an inventory array of golf clubs of a given number golf club head. Individual heads comprise a front striking face, a sole, a toe and a heel. The front striking face has a top and a bottom. The front striking face of individual heads has a series of grooves of common cross-sectional shape from the top to the bottom. The golf club heads of the golf clubs of the inventory array are characterized at least by at least two different groove designs in the front striking face. Such groove design differences, by way of example only, might be as described above with respect to one or more of the preferred embodiments, or otherwise varying groove designs in the front striking face of a golf club of a particular number.

The method further includes considering an attribute of a golfer's golf game. Such attribute might include, by way of example only, a golfer's swing as determined visually, digitally or otherwise, a golfer's handicap, or some other attribute. The method contemplates selecting a golf club of the number for the golfer from the inventor array based at least in part on the considered attribute in relation to groove design within the inventory array.

For example, and by way of example only and with respect to degree of groove spin, a 3-iron for a low handicap golfer might be selected to maximize spin as compared to selecting a 3-iron for a golfer with a higher handicap. For example, the low handicap golfer might have an optimized set of clubs selected which tends to produce greater spin in the long irons than in the short irons. Alternately by way of example only, the low handicap golfer might have an optimized set of clubs selected which tends to produce constant spin throughout the set. The reverse or same relationships might of course also be selected low handicap and high handicap golfers.

Another considered aspect of the invention includes a method of matching a set of golf clubs to a golfer. Such comprises manufacturing an inventory array of golf club sets having individually numbered golf club heads progressing from a high numbered head to a low numbered head. Individual heads comprise a front striking face, a sole, a toe, and a heel. The front striking face has a top and a bottom. The front striking face of individual heads have a series of grooves of a common cross-sectional shape from the top to the bottom. The golf club sets of the inventory array are characterized at least by at least two different groove designs in the front striking face in at least one of the same number heads between at least two of the sets.

An attribute of the golfer's golf game is considered, for example, as described above. A golf club set for the golfer is selected from the inventory array based at least in part on the considered attribute in relation to groove design within the inventory array. Accordingly, this aspect of a matching method of the invention is considered with respect to a set of golf clubs, wherein the immediately preceding matching method is with respect to an individual golf club, and not necessarily to a set.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A correlated set of individually numbered golf club irons having heads progressing from a high numbered head to a low numbered head; individual heads having a front striking face, a sole, a toe, and a heel; the front striking faces of heads within the set individually having a planar area defining a progressively decreasing loft angle in going from the high numbered head to the low numbered head, the planar area having a top and a bottom, individual front striking faces having a series of grooves of a common cross sectional shape from the top to the bottom; for at least two chosen pairs of heads within the set, the grooves being configured to provide decreasing golf ball spin in going from the lower numbered head to the higher numbered head in the pair if the golf ball were hit by the faces by identical impacts at the same loft angle, the grooves being of different cross sectional shape in the pair; and the individual grooves having a base and opposing sidewalls which diverge from the base and extend outwardly in the direction of the front striking face; at least one of an opposing sidewall and the base comprising at least one protrusion which extends into the groove, the at least one protrusion having an outermost protruding surface which is curved.

2. The correlated set of individually numbered golf club irons of claim 1 wherein each of the sidewalls comprises opposing protrusions extending into the groove proximate the front striking face, the respective opposing sidewall protrusions extending inwardly from its sidewall to an apex which is displaced inwardly from the sidewall.

3. The correlated set of individually numbered golf club irons of claim 1 wherein each of the sidewalls comprises opposing protrusions extending into the groove proximate the front striking face, the respective opposing sidewall protrusions extending inwardly from its sidewall to an apex which is displaced inwardly from the sidewall, the apex displacement from the sidewall being different for the higher numbered head and the lower numbered head in the pair.

4. The correlated set of individually numbered golf club irons of claim 3 wherein the apex displacement from the sidewall is less for the lower numbered head than for the higher numbered head in the pair.

5. The correlated set of individually numbered golf club irons of claim 3 wherein the apex displacement from the sidewall is less for the higher numbered head than for the lower numbered head in the pair.

6. The correlated set of individually numbered golf club irons of claim 3 wherein the respective opposing sidewall protrusions comprise a curved outer surface which starts from the front striking face.

7. The correlated set of individually numbered golf club irons of claim 1 wherein each of the sidewalls comprises opposing protrusions extending into the groove proximate the front striking face, the respective opposing sidewall protrusions having an outer surface characterized by a substantially constant radius of curvature, the radius of curvature being greater for the higher numbered head than for the lower numbered head in the pair.

8. The correlated set of individually numbered golf club irons of claim 7 wherein the radius of curvature is defined from an origin received outwardly of the respective sidewall.

9. The correlated set of individually numbered golf club irons of claim 1 wherein the base and opposing sidewalls meet at respective corner regions, the at least one protrusion being spaced from each of the corner regions.

10. A correlated set of individually numbered golf club irons having heads progressing from a high numbered head to a low numbered head; individual heads having a front striking face, a sole, a toe, and a heel; the front striking faces of heads within the set individually having a planar area defining a progressively decreasing loft angle in going from the high numbered head to the low numbered head, the planar area having a top and a bottom, individual front striking faces having a series of grooves of a common cross sectional shape from the top to the bottom; for at least two chosen pairs of heads within the set, the grooves being configured to provide decreasing golf ball spin in going from the lower numbered head to the higher numbered head in the pair if the golf ball were hit by the faces by identical impacts at the same loft angle, the grooves being of different cross sectional shape in the pair; and the individual grooves having a base and opposing sidewalls which diverge from the base and extend outwardly in the direction of the front striking face; at least one of an opposing sidewall and the base comprising at least one protrusion which extends into the groove, the base and opposing sidewalls meeting at respective corner regions, the at least one protrusion being spaced from each of the corner regions.

11. A correlated set of individually numbered golf club irons having heads progressing from a high numbered head to a low numbered head; individual heads having a front striking face, a sole, a toe, and a heel; the front striking faces of heads within the set individually having a planar area defining a progressively decreasing loft angle in going from the high numbered head to the low numbered head, the planar area having a top and a bottom, individual front striking faces having a series of grooves of a common cross sectional shape from the top to the bottom; for at least two chosen pairs of heads within the set, the grooves being configured to provide decreasing golf ball spin in going from the lower numbered head to the higher numbered head in the pair if the golf ball were hit by the faces by identical impacts at the same loft angle, the grooves being of different cross sectional shape in the pair; and the individual grooves having a base and opposing sidewalls which diverge from the base and extend outwardly in the direction of the front striking face; at least one of an opposing sidewall and the base comprising at least one protrusion which extends into the groove, the at least one protrusion having an outermost protruding surface which is spaced inwardly of the front striking face.

12. The correlated set of individually numbered golf club irons of claim 11 wherein the base and opposing sidewalls meet at respective corner regions, the at least one protrusion being spaced from each of the corner regions.

13. The correlated set of individually numbered golf club irons of claim 11 wherein the outermost protruding surface is curved.

14. The correlated set of individually numbered golf club irons of claim 13 wherein the base and opposing sidewalls meet at respective corner regions, the at least one protrusion being spaced from each of the corner regions.

15. A correlated set of individually numbered golf club irons having heads progressing from a high numbered head to a low numbered head; individual heads having a front striking face, a sole, a toe, and a heel; the front striking faces of heads within the set individually having a planar area defining a progressively decreasing loft angle in going from the high numbered head to the low numbered head, the planar area having a top and a bottom, individual front striking faces having a series of grooves of a common cross sectional shape from the top to the bottom; for at least two chosen pairs of heads within the set, the grooves being configured to provide decreasing golf ball spin in going from the lower numbered head to the higher numbered head in the pair if the golf ball were hit by the faces by identical impacts at the same loft angle, the grooves being of different cross sectional shape in the pair;

the individual grooves having a base and opposing sidewalls which diverge from the base and extend outwardly in the direction of the front striking face, the sidewalls comprising opposing protrusions extending into the groove proximate the front striking face, the respective opposing sidewall protrusions extending inwardly from its sidewall to an apex which is displaced inwardly from the sidewall; and the groove base and sidewalls defining a symmetrical groove cross section; the base comprising a protrusion extending in the direction of the front striking face, the base protrusion having an apex received inwardly of the front striking face.

16. A correlated set of individually numbered golf club irons having heads progressing from a high numbered head to a low numbered head; individual heads having a front striking face, a sole, a toe, and a heel; the front striking faces of heads within the set individually having a planar area defining a progressively decreasing loft angle in going from the high numbered head to the low numbered head, the planar area having a top and a bottom, individual front striking faces having a series of grooves of a common cross sectional shape from the top to the bottom; for at least two chosen pairs of heads within the set, the grooves being configured to provide decreasing golf ball spin in going from the lower numbered head to the higher numbered head in the pair if the golf ball were hit by the faces by identical impacts at the same loft angle, the grooves being of different cross sectional shape in the pair;

the individual grooves having a base and opposing sidewalls which diverge from the base and extend outwardly in the direction of the front striking face, the sidewalls comprising opposing protrusions extending into the groove proximate the front striking face, the respective opposing sidewall protrusions extending inwardly from its sidewall to an apex which is displaced inwardly from the sidewall;

the groove base and sidewalls defining a symmetrical groove cross section; the base comprising a protrusion extending in the direction of the front striking face, the base protrusion having an apex received inwardly of the front striking face; and the set being characterized by at least one of (A) and (B) as follows:

(A): the sidewall protrusion apex displacements from the respective sidewalls being different for the higher numbered head and the lower numbered head in the pair;

(B): the base protrusion apex being displaced inwardly of the front striking face a greater amount in the lower numbered head compared to the higher numbered head in the pair.

17. The correlated set of individually numbered golf club irons of claim 16 characterized by both (A) and (B).

18. A correlated set of individually numbered golf club irons having heads progressing from a high numbered head to a low numbered head; individual heads having a front striking face, a sole, a toe, and a heel; the front striking faces of heads within the set individually having a planar area defining a progressively decreasing loft angle in going from the high numbered head to the low numbered head, the planar area having a top and a bottom, individual front striking faces having a series of grooves of a common cross sectional shape from the top to the bottom; for at least two chosen pairs of heads within the set, the grooves being configured to provide decreasing golf ball spin in going from the lower numbered head to the higher numbered head in the pair if the golf ball were hit by the faces by identical impacts at the same loft angle; and wherein the individual grooves have a base and opposing sidewalls which diverge from the base and extend outwardly in the direction of the front striking face, and define a symmetrical groove cross section; the base comprising a protrusion extending in the direction of the front striking face, the base protrusion having an apex received inwardly of the front striking face.

19. The correlated set of individually numbered golf club irons of claim 9 wherein the grooves are of different cross sectional shape in the pair.

20. A correlated set individually numbered golf club irons having heads progressing from a high numbered head to a low numbered head; individual heads having a front striking face, a sole, a toe, and a heel; the front striking faces of heads within the set individually having a planar area defining a progressively decreasing loft angle in going from the high numbered head to the low numbered head, the planar area having a top and a bottom, individual front striking faces having a series of grooves of a common cross sectional shape from the top to the bottom; for at least two chosen pairs of heads within the set, the grooves being configured to provide decreasing golf ball spin in going from the lower numbered head to the higher numbered head in the pair if the golf ball were hit by the faces by identical impacts at the same loft angle; and wherein the individual grooves have a base and opposing sidewalls which diverge from the base and extend outwardly in the direction of the front striking face, and define a symmetrical groove cross section; the base comprising a protrusion extending in the direction of the front striking face, the base protrusion having an apex received inwardly of the front striking face; the apex being displaced inwardly of the front striking face a greater amount in the higher numbered head compared to the lower numbered head in the pair.

21. A golf club iron head comprising a front striking face, a sole, a toe, and a heel; the front striking face having a planar area having a top and a bottom; the front striking face having a series of grooves of a common cross sectional shape from the top to the bottom; individual grooves having a base and opposing sidewalls which diverge from the base and extend outwardly in the direction of the front striking face, and define a symmetrical groove cross section; the base comprising a protrusion extending in the direction of the front striking face, the base protrusion having an apex received inwardly of the front striking face.

22. The golf club iron head of claim 21 wherein the base comprises only a single protrusion.

23. The golf club iron head of claim 21 wherein the base protrusion has opposing base walls which converge in the direction of the apex.

24. The golf club iron head of claim 21 wherein the apex is defined on a base protrusion outermost surface which is curved.

25. The golf club iron head of claim 24 wherein the outermost surface has a substantially constant radius of curvature.

26. The golf club iron head of claim 24 wherein the outermost surface has a substantially constant radius of curvature which is defined from an origin received outwardly of the respective sidewall.

27. The golf club iron head of claim 21 wherein the apex is at least 0.001 inch inwardly of the front striking face.

28. The golf club iron head of claim 21 wherein the apex is no more than 0.018 inch inwardly of the front striking face.

29. The golf club iron head of claim 21 wherein the apex is at least 0.001 inch inwardly of the front striking face, and no more than 0.018 inch inwardly of the front striking face.

30. The golf club iron head of claim 21 wherein the base includes a flat portion.

31. The golf club iron head of claim 21 wherein the apex is centrally located between the sidewalls.

32. The golf club iron head of claim 21 wherein the base protrusion has opposing base walls, and variable width between the groove sidewalls.

33. The golf club iron head of claim 21 wherein the base protrusion has opposing base walls, and continuously variable width between the groove sidewalls.

34. The golf club iron head of claim 21 wherein the base protrusion has opposing base walls, and a minimum width between the groove sidewalls of from 0.001 inch to 0.025 inch.

35. The golf club iron head of claim 21 wherein the base protrusion has opposing base walls, variable width between the groove sidewalls, and a minimum width between the groove sidewalls of from 0.001 inch to 0.025 inch.

36. The golf club iron head of claim 21 wherein the base protrusion has opposing base walls, continuously variable width between the groove sidewalls, and a minimum width between the groove sidewalls of from 0.001 inch to 0.025 inch.

37. A correlated set of individually numbered golf club irons having heads progressing from a high numbered head to a low numbered head; individual heads having a front striking face, a sole, a toe, and a heel; the front striking faces of heads within the set individually having a planar area defining a progressively decreasing loft angle in going from the high numbered head to the low numbered head, individual grooves having a base and opposing sidewalls which diverge from the base and extend outwardly in the direction of the front striking face, and define a symmetrical groove cross section; the base comprising a protrusion extending in the direction of the front striking face, the base protrusion having an apex received inwardly of the front striking face; for at least two chosen pairs of heads within the set, the apex being displaced inwardly of the front striking face a greater amount in the higher numbered head compared to the lower numbered head in the pair.

38. The correlated set of individually numbered golf club irons of claim 37 wherein the respective base protrusions have opposing base walls which converge in the direction of the apex.

39. The correlated set of individually numbered golf club irons of claim 37 wherein the respective apexes are defined on a base protrusion surface which is curved.

40. The correlated set of individually numbered golf club irons of claim 37 wherein the respective apexes are centrally located between the sidewalls.

* * * * *

UNITED STATES PATENT AND TRADEMARK OFFICE

CERTIFICATE OF CORRECTION

PATENT NO. : 6,733,400 B2
APPLICATION NO. : 09/838944
DATED : May 11, 2004
INVENTOR(S) : Sherwood It is certified that error appears in the above-identified patent and that said Letters Patent is hereby corrected as shown below:

Title Page, in the (item 54), line 1, please delete "GOLD" before "CLUB" and insert --GOLF--.

Col. 3, line 39, please insert --no-- after "in".

Col. 9, line 35, please delete "inventor" after "from the" and insert --inventory--.

Col. 9, line 48, please insert --by--. After "selected".

Col. 13, line 27, claim 19, please delete "9" after "claim" and insert --18--.

Col. 13, line 29, claim 20, please insert --of-- after "set".

Signed and Sealed this

Twenty-fifth Day of July, 2006

JON W. DUDAS
*Director of the United States Patent and Trademark Office*